US008235175B1

(12) United States Patent
Feldhaus

(10) Patent No.: US 8,235,175 B1
(45) Date of Patent: Aug. 7, 2012

(54) LADDER STANDOFF ARRANGEMENT

(76) Inventor: Daniel E. Feldhaus, Indiana, IN (US)

( * ) Notice: Subject to any disclaimer, the term of this patent is extended or adjusted under 35 U.S.C. 154(b) by 1357 days.

(21) Appl. No.: 11/039,096

(22) Filed: Jan. 20, 2005

(51) Int. Cl.
*E06C 7/00* (2006.01)

(52) U.S. Cl. ..... 182/214; 182/106; 182/107; 403/359.1; 403/359.6

(58) Field of Classification Search ..... 182/214, 182/107, 106; 248/235, 211, 210, 238; 464/49, 464/74, 149, 150, 154, 158; 403/359.1, 359.6
See application file for complete search history.

(56) References Cited

U.S. PATENT DOCUMENTS

| | | | | | |
|---|---|---|---|---|---|
| 2,439,430 | A | * | 4/1948 | Hurd | 182/206 |
| 2,466,097 | A | * | 4/1949 | Graue | 403/356 |
| 2,541,343 | A | * | 2/1951 | Dakin | 248/238 |
| 2,859,599 | A | * | 11/1958 | Case | 464/88 |
| 3,197,216 | A | * | 7/1965 | Jackson | 277/500 |
| 3,459,277 | A | * | 8/1969 | Frederick | 182/214 |
| 4,311,210 | A | * | 1/1982 | Jackson | 182/214 |
| 4,331,217 | A | * | 5/1982 | Stecklow | 182/214 |
| 4,357,137 | A | * | 11/1982 | Brown | 464/75 |
| 5,165,501 | A | * | 11/1992 | Donahey | 182/214 |
| 5,855,252 | A | * | 1/1999 | Vrolyks | 182/214 |
| 6,595,324 | B2 | * | 7/2003 | Brown | 182/106 |

FOREIGN PATENT DOCUMENTS

| | | | | |
|---|---|---|---|---|
| GB | 2118236 | A * | 10/1983 | 182/214 |

* cited by examiner

*Primary Examiner* — Katherine W Mitchell
*Assistant Examiner* — Colleen M Chavchavadze
(74) *Attorney, Agent, or Firm* — Barnes & Thornburg LLP

(57) ABSTRACT

A standoff arrangement for ladders and the like, comprising a ladder attachment portion and a ladder support portion. The attachment portion is releasably securable to ladder, and the support portion extends from the ladder attachment portion, having a pair of individually adjustable bearing arms which can be universally adjusted in relation to the structure against which the ladder standoff arrangement bears.

12 Claims, 5 Drawing Sheets

LADDER STANDOFF ARRANGEMENT

BACKGROUND OF THE INVENTION

This invention relates to ladder standoffs, and in particular to a ladder standoff arrangement which is readily attached and removed from a ladder, and which is universally adjustable to accommodate standing the ladder off from an almost unlimited array of surfaces.

Ladder standoffs, also known as ladder supports, have been developed over the years and are provided in a myriad of forms and shapes. The purpose of a ladder standoff is to perform as its name implies, to stand the ladder away from a structure against which the ladder is being used. Also, ladder standoffs typically stabilize a ladder by providing a wider stance against the surface or structure against which the ladder is being used. Examples of ladder standoffs are found in U.S. Pat. Nos. 2,432,189; 2,903,086; 3,288,249; 3,568,801; 4,061,203; 4,502,566; 5,113,973; 5,121,814; 5,261,507 and 5,855,252. While the structures of these ladders standoffs provide viable adjuncts for ladders, they all suffer the deficiencies of being insufficiently adjustable, and generally expect that the structures against which they are to be used have a relatively flat, even surface, when such is often not the case.

SUMMARY OF THE INVENTION

The invention is directed to a standoff arrangement for a ladder or the like, comprising a ladder attachment portion and a ladder support portion, with the ladder support portion extending from the ladder attachment portion. The ladder attachment portion comprises a pair of spaced bracket assemblies, each bracket assembly including at least one rung clamp, the bracket assemblies being spaced to engage different rungs of a ladder. The ladder support portion comprises a cross member and a pair of individually adjustable bearing arms extending from the cross member.

In accordance with the preferred form of the invention, each of the bracket assemblies includes a pair of spaced rung clamps. Also included is at least one ladder lock. In the preferred form of the invention, the ladder lock comprises at least one removable pin engaging one of the rung clamps in order to secure the ladder attachment portion to a ladder. Preferably, there are two of the pins, each pin engaging a different one of the rung clamps.

In accordance with the preferred form of the invention, a pair of lug assemblies is provided, each lug assembly securing one of the bearing arms of the ladder support portion to the cross member. Each lug assembly comprises a mounting lug and a receiving lug, with the lugs being shaped to engage in an interlocking relationship. The lugs engage over an arc of adjustability, with that arc of adjustability being greater than 90 degrees.

The bracket assemblies are mounted on a frame, and the cross member is also secured to the frame. All frame portions of the standoff arrangements are preferably tubular members for weight and strength purposes.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
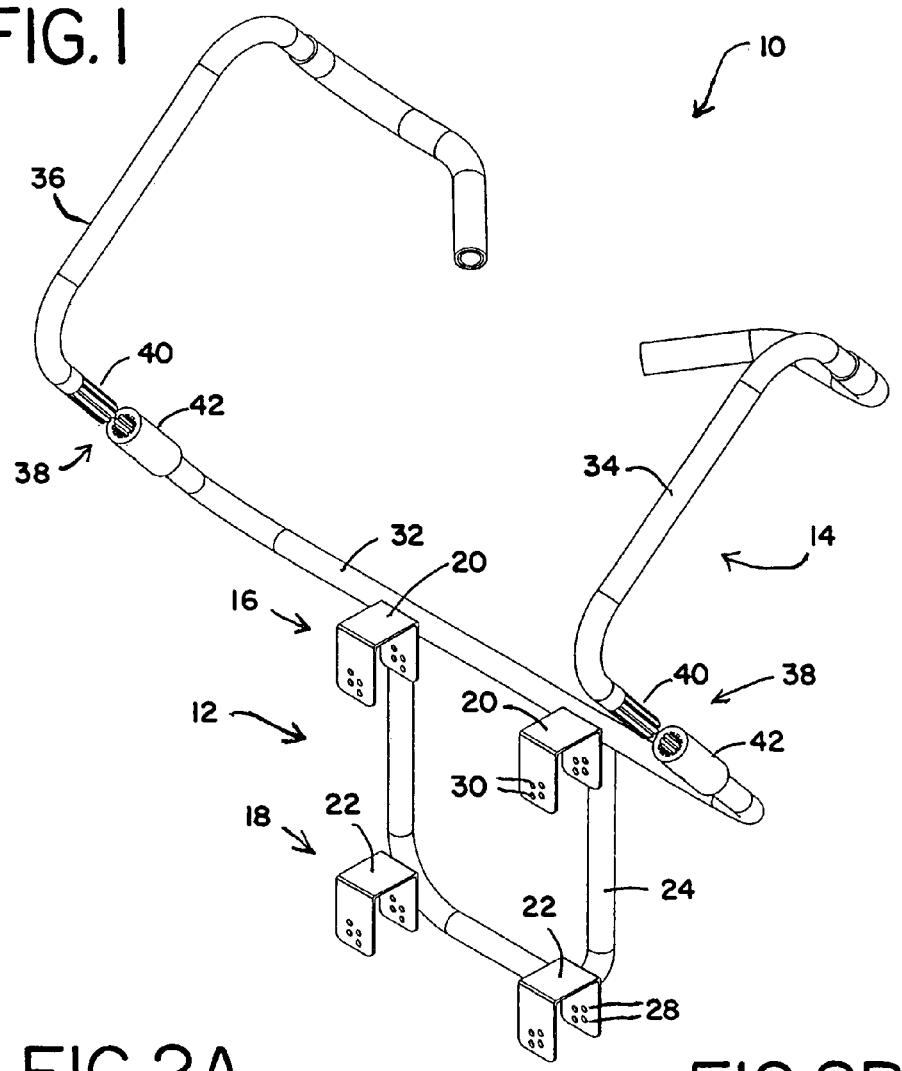
FIG. 1 is a prospective view of a ladder standoff arrangement according to the invention.
Figure 2A:
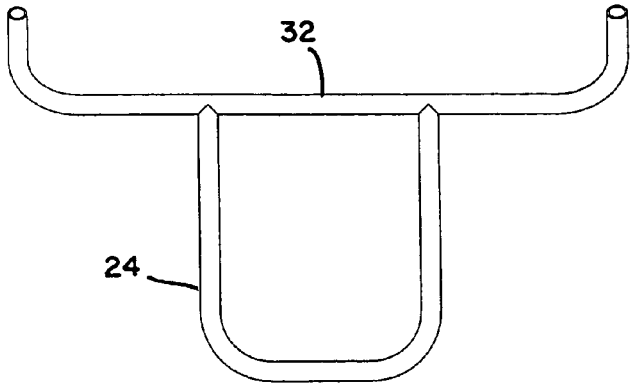
FIG. 2A is an elevational illustration of parts of the ladder attachment portion and the ladder support portion when fabricated.
Figure 2B:
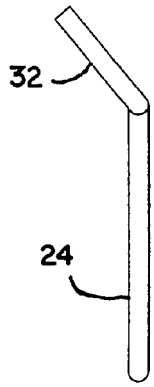
FIG. 2B is a side elevational illustration thereof.
Figure 3A:
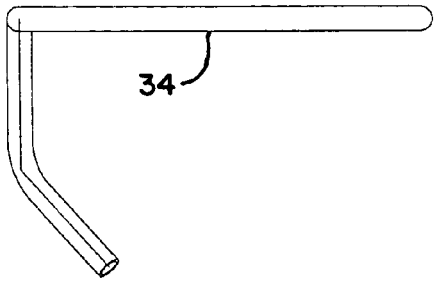
FIGS. 3A, 3B and 3C are elevational illustrations of one of the adjustable bearing arms of the ladder support portion.
Figure 3B:
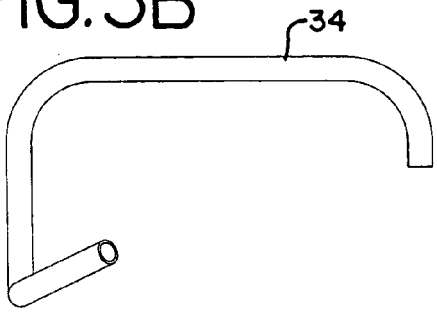
Figure 3C:
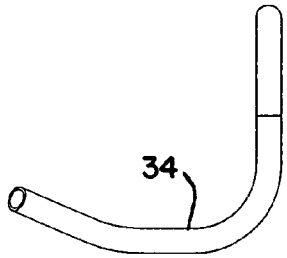
Figure 4A:
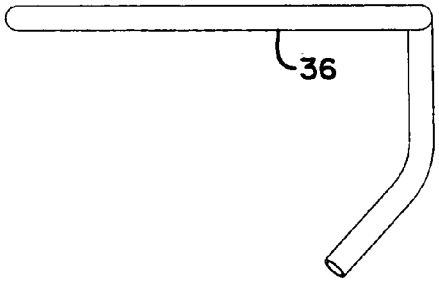
FIGS. 4A, 4B and 4C are elevational illustrations of the other of the adjustable bearing arms of the ladder support portion.
Figure 4B:
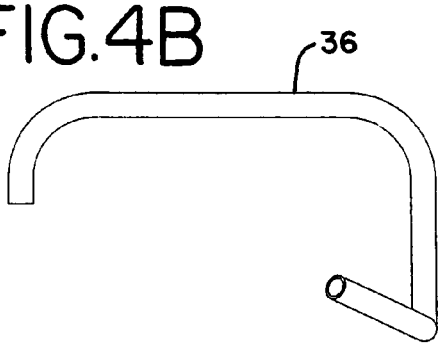
Figure 4C:
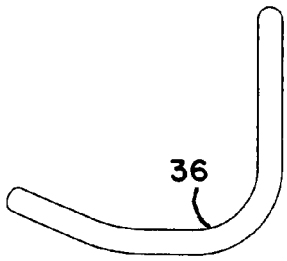

A ladder standoff arrangement according to the invention is shown generally at 10 in the drawing figures. The ladder standoff arrangement 10 consists of two basic components, a ladder attachment portion 12 and a ladder support portion 14.

Figure 8:
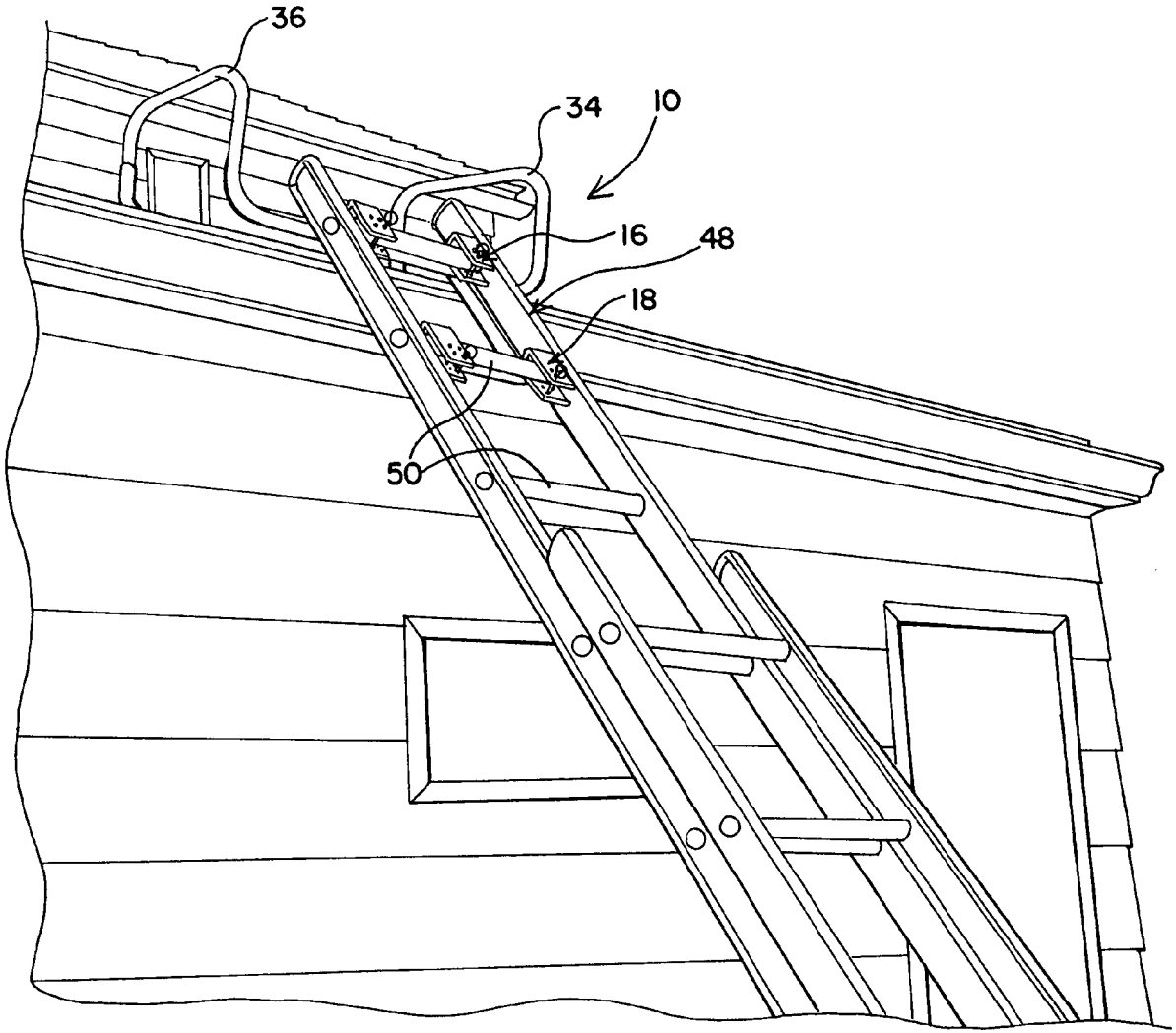
FIG. 8 illustrates one manner of using the standoff arrangement of the invention once secured to a ladder and deployed against a building.

The ladder attachment portion comprises a pair of spaced bracket assemblies 16 and 18. The bracket assembly 16 is composed of a pair of rung clamps 20 and the bracket assembly 18 is composed of a pair of rung clamps 22, the rung clamps 20 and 22 being mounted on a U-shaped frame 24, which is preferably manufactured of tubular steel. The bracket assemblies 16 and 18 are spaced to engage different rungs of a ladder, as illustrated in FIG. 8.

Figure 7A:
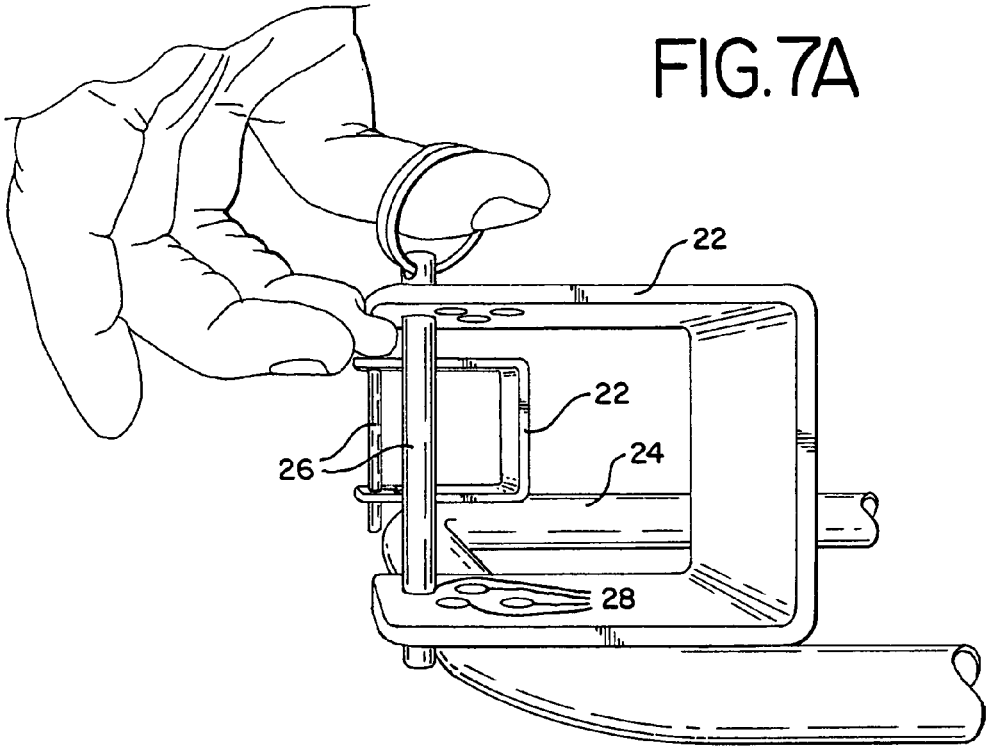
FIG. 7A is an enlarged illustration of the lower bracket assembly of the ladder attachment portion, illustrating the removable pins forming the ladder locks.
Figure 7B:
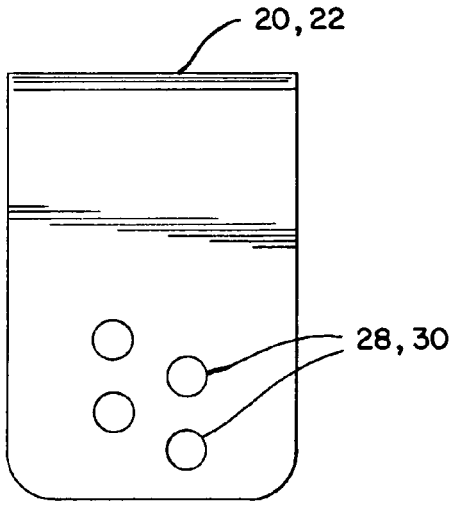
FIGS. 7B and 7C are enlarged illustrations of the rung clamps.
Figure 7C:
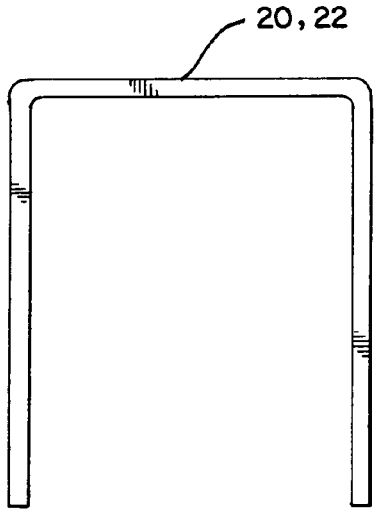

It is important that the standoff arrangement, when installed on a ladder, be maintained in place. To that end, at least one ladder lock is provided. As shown in FIG. 7, the ladder lock comprises at least one removable pin 26 engaging one of the rung clamps 22. Preferably, for stability, there are two of the pins 26, which can be of conventional design and which are installed through any one of a series of holes 28 in the rung clamps 22 or holes 30 in the rung clamps 20. A series of the holes 28 and 30 is provided for ease of accommodating ladder rungs of varying sizes.

The ladder support portion 14 includes a cross member 32 and a pair of individually adjustable bearing arms 34 and 36 which extend from the cross member 32. Preferably, the cross member 32 is welded to the U-shaped frame 24, and the rung clamps 20 and 22 are welded in place, as well, forming a ridget structure. The bearing arms 34 and 36, however, being adjustable, are removable from the cross member 32 and are mounted thereon by means of a pair of lug assemblies 38. Each of the lug assemblies 38 is composed of a mounting lug 40 and a receiving lug 42. As illustrated, each of the mounting lugs 40 is secured to one or the other of the bearing arms 34 or 36, and the receiving lugs are secured to opposite ends of the cross member 32, although obviously the opposite could also function quite adequately.

Figure 5B:
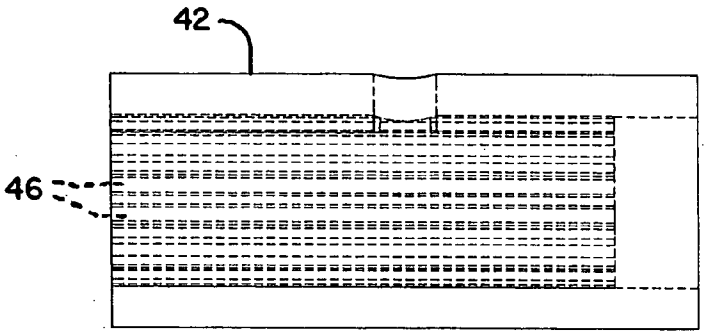
FIGS. 5A and 5B are enlarged illustrations of one of the receiving lugs according to the invention.
Figure 6B:
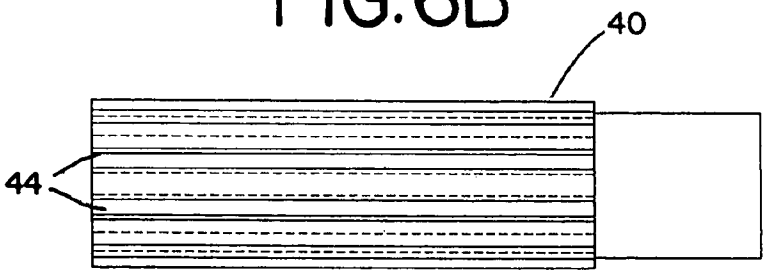
FIGS. 6A and 6B are enlarged illustrations of the one of the mounting lugs according to the invention.
Figure 5A:
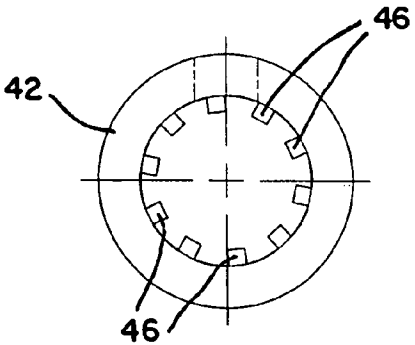
Figure 6A:
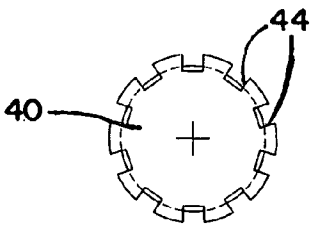

As best shown in FIGS. 5 and 6, the lugs 40 and 42 are shaped to engage in an interlocking relationship, to maintain the bearing arms 34 and 36 in place when installed. The mounting lugs 40 include a series of outer longitudinal channels 44, and the receiving lugs 42 include a series of spaced longitudinal teeth 46 which engage the channels 44 when the mounting and receiving lugs 40 and 42 are joined. The channel 44 and teeth 46 are shaped appropriately so that when the lug assemblies 38 are formed by joining the mounting lug 42 the receiving lug 42, the lug 40 and 42 are interlocked and force must be applied to separate them. Thus, when the standoff arrangement 10 is assembled, the bearing arms 34 and 36 remain in place until changing of their orientations in relation to the cross member 32 is desired.

Because of the universal formation of the lugs 40 and 42 of the lug assemblies 38, the lugs 40 and 42 can universally engage in any one of a myriad of positions. This allows the lugs 40 and 42 to engage in an arc of adjustability for adjusting the positions of the bearing arms 34 and 36. Preferably the arc of adjustability is greater than 90 degrees to permit adjustment of the bearing arms 34 and 36 to accommodate any surface encountered by the standoff arrangement 10, although given the nature of the lug assemblies 38 illustrated, that adjustability is actually through a full 360 degrees, so that the bearing arms 34 and 36 can be mounted at any desired position.

In use, the standoff arrangement 10 is, as best shown in FIG. 8, mounted on a ladder 48 by engaging successive rungs 50 thereof with the bracket assemblies 16 and 18. The pins 26 are locked in place, and the standoff arrangement 10 is then securely fastened to the ladder 48.

Depending on the surface against which the standoff assembly is to bear, the arms 34 and 36 can be individually adjusted. While in many instances, the arms 34 and 36 will be deployed in a forward orientation as shown in FIGS. 1 and 8, because of the nature of the lug assemblies 38, the arm 34 and 36 can be rotated so that varying surfaces can be engaged by the standoff assembly 10 to hold the ladder 48 in place. Thus, as illustrated in FIG. 8, the standoff assembly 10 can stand the ladder 48 away from a building while engaging the building's roof, or the arms 34 and 36 can engage the vertical portions of the building to stand the ladder 48 off, or any combination of orientations can be achieved. Not only that, in instances where an even wider standoff assembly is desired, the arms 34 and 36 can be interchanged, and rather than having bearing portions pointing toward one another as best illustrated in FIG. 1, those bearing portions would point away from one another.

Various changes can be made to the invention without departing from the spirit thereof or scope of the following claims.

What is claimed is:

1. A standoff arrangement for a ladder, comprising a. a ladder attachment portion and a ladder support portion, the ladder support portion extending from the ladder attachment portion, b. the ladder attachment portion comprising a pair of spaced bracket assemblies, each bracket assembly including at least one rung clamp, the bracket assemblies being spaced to engage different rungs of a ladder, c. the ladder support portion comprising a cross member and a pair of individually adjustable bearing arms extending from said cross member, and d. a pair of interlocking toothed lug assemblies, each lug assembly securing one of said bearing arms to said cross member and permitting rotation of said bearing arm relative to said cross member, each lug assembly having a mounting lug including a series of radially spaced longitudinal channels and a receiving lug including a series of radially spaced longitudinal teeth shaped to engage said channels.

2. The ladder standoff arrangement according to claim 1 in which each bracket assembly includes a pair of spaced rung clamps.

3. The ladder standoff arrangement according to claim 2 including at least one ladder lock.

4. The ladder standoff arrangement according to claim 3 in which said ladder lock comprises at least one removable pin engaging one of said rung clamps.

5. The ladder standoff arrangement according to claim 4 including two of said pins, each pin engaging a different one of said rung clamps.

6. The ladder standoff arrangement according to claim 1 including at least one ladder lock.

7. The ladder standoff arrangement according to claim 6 in which said ladder lock comprises at least one removable pin engaging one of said rung clamps.

8. The ladder standoff arrangement according to claim 7 including two of said pins, each pin engaging a different one of said rung clamps.

9. The ladder standoff arrangement according to claim 1 in which said lugs engage in an arc of adjustability.

10. The ladder standoff arrangement according to claim 9 in which said arc of adjustability is greater than 90 degrees.

11. The ladder standoff arrangement according to claim 1 in which said bracket assemblies are mounted on a frame, and said cross member is secured to said frame.

12. The ladder standoff arrangement according to claim 11 in which said frame and said cross member are tubular members.

* * * * *